US007946438B2

(12) United States Patent
Dobbelstein et al.

(10) Patent No.: US 7,946,438 B2
(45) Date of Patent: May 24, 2011

(54) PT CLOSING DEVICE FOR CONTAINERS

(75) Inventors: Peter Dobbelstein, Babenhausen (DE); Carsten Pfromm, Hannover (DE)

(73) Assignee: Silgan Holdings Inc., Stamford, CT (US)

( * ) Notice: Subject to any disclaimer, the term of this patent is extended or adjusted under 35 U.S.C. 154(b) by 754 days.

(21) Appl. No.: 11/572,881

(22) PCT Filed: Jul. 29, 2005

(86) PCT No.: PCT/DE2005/001346
§ 371 (c)(1),
(2), (4) Date: Nov. 6, 2007

(87) PCT Pub. No.: WO2006/012872
PCT Pub. Date: Feb. 9, 2006

(65) Prior Publication Data

US 2008/0105641 A1 May 8, 2008

(30) Foreign Application Priority Data

Jul. 30, 2004 (DE) ..... 10 2004 037 023
Aug. 5, 2004 (DE) ..... 10 2004 038 144

(51) Int. Cl.
*B65D 41/32* (2006.01)
*B65D 51/18* (2006.01)

(52) U.S. Cl. ..... 215/252; 220/254.1

(58) Field of Classification Search ..... 215/280, 215/283, 273, 318, 317, 316, 341, 200; 222/265, 222/260, 254.8, 254.1, 255.1, 255, 309.1, 222/259.5, 256.1, FOR. 104, FOR. 103, FOR. 203, 222/FOR. 204, 153.1, 153.09
See application file for complete search history.

(56) References Cited

U.S. PATENT DOCUMENTS

| | | | | |
|---|---|---|---|---|
| 3,741,423 | A | 6/1973 | Acton et al. | |
| 4,560,076 | A | 12/1985 | Boik | |
| 4,607,757 | A | 8/1986 | Lecinski | |
| 4,610,367 | A * | 9/1986 | Massott et al. | 215/252 |
| 4,657,153 | A | 4/1987 | Hayes | |
| 4,805,791 | A | 2/1989 | Begley | |

(Continued)

FOREIGN PATENT DOCUMENTS

DE 2 233 305 A 1/1974

(Continued)

*Primary Examiner* — Anthony Stashick
*Assistant Examiner* — Robert J Hicks
(74) *Attorney, Agent, or Firm* — Greenblum & Bernstein, PLC

(57) ABSTRACT

The invention is directed to a closing device for a closure lid made of sheet metal suitable for opening by twisting, as well as a support device on or for such closure lid, as well as the closure lid itself and a process of making such closure lid. The closing device includes a lid panel; a skirt portion on an edge of the lid panel; a seal extending from a circumferential section of the lid panel into the skirt portion. In addition, the closing device has a non-metallic safety ring that includes two circumferentially extending sections, configured as a safety section with a strip section, shaped to project radially inwards and axially upwards, as well as a connecting section for attaching the safety section on an axially lower end of the skirt portion. The skirt portion has a lower end rolled up from radial outside to radial inside by more than 180° to form a roll-up portion, the roll-up portion being at least partly clasped, or is claspable, by the connecting section from an inner side of the skirt portion.

37 Claims, 3 Drawing Sheets

U.S. PATENT DOCUMENTS

| | | | |
|---|---|---|---|
| 4,813,561 | A | 3/1989 | Ochs |
| 4,936,474 | A | 6/1990 | Szczesniak et al. |
| 4,967,920 | A | 11/1990 | Dahl |
| 4,978,016 | A | 12/1990 | Hayes |
| 4,981,230 | A | 1/1991 | Marshall et al. |
| 4,989,740 | A | 2/1991 | Vercillo |
| 5,027,964 | A | 7/1991 | Banich, Sr. |
| 5,031,787 | A | 7/1991 | Ochs |
| 5,058,755 | A | 10/1991 | Hayes |
| 5,190,177 | A | 3/1993 | Collins et al. |
| 5,685,443 | A | 11/1997 | Taber et al. |
| 6,056,136 | A | 5/2000 | Taber et al. |
| 2003/0102281 | A1 | 6/2003 | Ryall et al. |

FOREIGN PATENT DOCUMENTS

| | | | |
|---|---|---|---|
| DE | 88 01 747 | U1 | 3/1988 |
| DE | 88 01 748 | U1 | 4/1988 |
| EP | 0 450 959 | B1 | 12/1994 |
| EP | 1 155 966 | A1 | 11/2001 |
| WO | WO-96/11856 | A1 | 4/1996 |
| WO | WO-98/52833 | A1 | 11/1998 |

* cited by examiner

PT CLOSING DEVICE FOR CONTAINERS

BACKGROUND OF THE INVENTION

1. Field of the Invention

The invention relates to a closing device on a closure lid and a closing device for such a lid made of sheet metal, the lid serving for closing containers and being pressed on from the top by means of an axial pressure on thread webs with the formation of thread elements in the lid that are negatively pushed into a (sealing) compound. Subsequently, these lids can be opened by means of twisting, the concept of a PT closure lid (press twist) being derived from this. The invention also relates to a closing aid (closing support device) for a lid for closing an upper open end of a container, in particular a glass container.

2. Description of Background and Other Information

Such PT closure lids are known as a type of White Cap closure lids, e.g., EP-450 959 (CMB), in particular FIG. 2 thereof with a cross-section with a thread web 16 at the neck of the container and a sealing compound 30, which, on the one hand, rests sealingly against the axial end of the body and, on the other hand, defines a counter-thread element with respect to the thread web 16. PT closures are well and correctly explained in column 1, paragraphs 1 and 2 thereof. Other types of closures of such lids (closure lids) are screw-type caps such as in DE-A 22 33 305 (Crown-Bender) or closure lids of the type of U.S. Pat. No. 4,607,757 (White Cap), in particular FIG. 2 thereof.

A plastic safety device is known from DE-U 88 01 748.6 (Alcoa), which can be attached to metallic screw-type closures for bottles and containers of the same kind with a threaded neck portion. The very short description of the document is at best revealed by FIG. 1, i.e., the only drawing figure, which is a cross-section with the relevant explanation that two hook elements are connected with each other through a detachment section (6 thereof), the upper hook element resting against a metallic end flange of the lid, that is rolled outwards and the lower hook element engaging a surface of the thread neck, which points downwards in a substantially axial fashion as a safety measure. This is the closed condition. The contact surface for locking does not take place on a surface that is the upper lateral outer wall, but on an outer wall that points downwards and is directed in a substantially radial fashion, but axially points downwards. In the cited document, the container indicated there is closed with an open end and an upper outer wall, the lid having a lid panel and a transition section and a skirt portion. A bead (8 thereof) of the skirt portion is encompassed by more than 150° by an upper hook element (4 thereof) of a plastic tamper-proof ring (FIG. 1 thereof), said plastic tamper-proof ring having a lower hook element (5 thereof) which can be ripped off at the webs (6 thereof). The foregoing terminology relates to that of the present invention.

SUMMARY

The invention includes a closure ring which can be attached on the metallic closure lid in an advantageous, simple and easy fashion and which forms a joint between an originality control (commonly referred to as tamper evidence) and the screw-on sheet metal lid. There are a plurality or a host of tamper-evident closures, which all have the function in common that a unique opening of the closure must be visible from the outside so that it can be observed from a packaging with the original closure in the case of an intact closure (called logically "seal"). The product to be packed and the bodies receiving it are complex, they range from foodstuffs and glass containers which are closed with sheet metal closures, to sheet metal containers which must also be closed with sheet metal closures.

To these ends, the closing device of the invention has a safety ring consisting of two circumferential elements or by a process.

The lid as such which is produced from sheet metal cannot guarantee the safety indication (the seal), it only forms the object that is secured. The lid has a lid panel, a circumferential skirt portion which is aligned substantially vertically to the lid panel and has a sealing layer in the skirt portion, which also extends to a circumferential portion of the lid panel (located on the side of the edge). This area serves, on the one hand, as a sealing on the front side of the container body and, on the other hand, as a thread to be formed with respect to the cams or thread elements provided on the container which, here, extend in each case for a specific length on the circumference, but extend in a staggered and oblique fashion in the circumferential direction and axial direction.

The safety ring is not made of metal. It is, e.g., made of a plastic material which enables it to be elastic-resilient, on the one hand, and, on the other hand, also makes a thin place which can be ripped off in order to indicate the "first opening."

The safety section and the connecting section, which form the two functional parts of the safety ring, have a folded strip portion on the safety section, which is also called a J-band in this technical field, cf. in this connection U.S. Pat. No. 4,981,230 (Marshall) or DE-U 88 01 748 (Alcoa), FIG. 1 thereof.

This J-band is disposed on the safety section and forms the folded strip portion which engages under a radial projection of the body in the closed condition and thus has an initial locking effect on an opening movement. The so-called strip portion which, at first, locks against an axial displacement of the lid is disposed on the safety section. The safety section, in turn, is connected with a roll-up of the lower end of the skirt portion through the connection section and fastened here in an elastically clamping fashion.

The elastic clamping is effected at a lower end of the skirt, which is rolled up by more than 180°, said roll-up being effected radially inwards towards the inner side with respect to the skirt portion of the lid. The connecting section provides for the clamping attachment. The safety section holds the J-band and effects the instantaneous block. The two are connected with each other by means of a thin place (that is possibly distributed along the circumference) so that they are separated from each other at least in areas upon the axial removal caused by a twisting and indicate the opening.

Said thin place may consist of a plurality of webs distributed along the circumference which are designed in such a thin fashion that they easily break or tear, the force with which the connecting section clasps the rolled up portion of the lid in a gripping fashion being greater than that force which is necessary for separating or ripping off the thin place.

The clasping is also done with respect to an encompassing angle which is larger than 150° and takes place around the rolled up lower end section of the lid skirt.

It is thus smaller than the angle of the roll-up, but sufficient for the retaining on the sheet metal lid.

Accordingly, the plastic part thus formed can be attached to the metallic lid axially from below and engages its roll-up and retains itself with the connecting section. Then, the lid has a connecting section that extends circumferentially and is disposed in a clamping or gripping fashion on the lower edge in the mounted condition and which cannot give away radially inwards (towards the interior of the lid) to such an extent that the gripping contact is detached without separating the thin place.

This is ensured by a circumferential limit distance that is not chosen to be large between an inner wall surface with respect to the gripping area (on the connecting section) and the projection provided on the container, which points radially. The connecting section with gripping area is designed in such a fashion that a giving away of the gripping area which is directed radially inwards does not ensure that the gripping connection contact of the safety ring can be (completely) detached from the rolled up lower edge of the sheet metal lid. Thus, the securing and the easy mounting of the safety ring are reliably achieved, which is disposed in a clamping and gripping fashion on the roll-up.

To ensure the placing of the safety ring, two annular surfaces face each other. The gap formed between these surfaces is smaller than the projection of the nose portion beyond the planar segment of the rolled up portion that projects at the greatest distance towards the inside. Thus, a slipping out of the grip portion from the retaining position on the rolled-up end portion of the skirt can be avoided.

The gripping elements which engage around the roll-up from the inner side of the skirt portion are circumferentially spaced individual projections and not imperatively a circumferentially completely continuous collar-shaped projection. The elastic resilience of the plastic part is of use here and makes the slipping over and the locking beyond the inwardly directed side of the edge roll-up of the skirt portion by these individual projections possible that extend in a circumferentially limited fashion.

The interior of the roll-up is not meant by "inner side", but is to refer to the closure lid which has an inner side, seen radially from the inside, which can be logically described as a cylindrical wall to be formed along the circumferential skirt.

The roll-up is at first displaced towards the outside by means of an outwardly directed saddle of the skirt wall and then formed radially inwards, a complete roll-up of almost 360° being preferably selected. It forms a high resistance and has a high inner stability in order to provide the gripping connecting section with a basis for its retaining function.

The securing section and the connecting section form jointly together with the folded strip portion the plastic part which is also of an independent importance. It can also be considered as a "closing device" without the sheet metal made of sheet metal with lid panel, skirt portion and sealing layer and the lower end of the skirt portion that is rolled up by more than 180°, which are additionally described there.

The clasping is done with the gripping area so that at least 150° of circumferential gripping contact, preferably more than about 240° to 270° for a larger circumferential contact on the ring roll-up as the lower edge of the skirt portion are made available.

The folded strip shape as the J-band may be designed in a such a way that it is bendable at a film hinge, which is circumferentially interrupted at several points and thus forms a window through which liquid may flow off, but also can facilitate the folding with a lesser inner resistance against the bending or folding movement of the strip portion.

Several of the circumferentially distributed webs between the securing section and the connecting section may be provided for determining the tear strength. They may be selected in the range between substantially five and twenty. They may have a small circumferential extension and a narrow radial dimensioning so that they can be easily separated and, at the same time, connect the securing section and the connecting section across the entire circumference with a small minimum distance as uniformly as possible, which, in the mounted condition, can be seen from the outside as a continuous gap.

As regards the connecting section, the partial clasping means both the circumferential direction in the direction of the skirt and, vertically to this, the circumferential direction around the roll-up. The circumferentially spaced grip segments on the connecting section are a partial clasping as is the wrapping of the edge roll-up which is more than 150°, however, at any rate, smaller than 300°, in particular smaller than about 270°.

If one hypothetically assumes a plane which corresponds to the central plane through the roll-up and which extends in parallel to the panel, four quadrants can be defined in this fashion which are comprised by the roll-up, the first quadrant is at the outside at the top, then, counter-clockwise, three further quadrants. The third quadrant (at the inside, at the bottom) is completely occupied by the clasping connecting section, the adjacent second and fourth quadrants only partly, it being also possible to extend the clasping into the fourth quadrant. As a result, this results in a self-supporting by means of positive locking, in particular also by means of the additionally applied non-positive locking.

During encompassing the radial dimension must be understood in such a way that it is directed towards the entire lid, i.e., the roll-up radially from the inside (seen radially from the outside as regards the roll-up) is at least partly encompassed. This direction is called "from the lid inside". The encompassing takes place from the outer side of the roll-up. Figuratively speaking, this encompassing can only be seen in a sectional view and additionally extends at least section-wise in the circumferential direction for a cylindrical container. This is only possible in a limited fashion in circumferential sections in the sense of one or more partially circumferential extension (s).

The defined plane as the central plane of the roll-up can be the beginning of an encompassing with a greatly outwardly projecting connecting section (extension into the fourth quadrant).

The weakening of the webs is calculated by means of the desired function. They are to be separated, if the metallic part of the lid is displaced upwards or circumferentially (by means of the twist movement); at the same time, this rotational movement is not to be rendered too difficult by the locking function of the webs (as the thin place). That is to say that the weakening is modeled on the intended use and, on the one hand, it can be defined so weakly that the opening is not additionally rendered substantially more difficult, and, on the other hand, it can be defined in such a thick way that an immediate ripping off of the thin place is not possible. "Weakness" and "strength" equally define the thin place which connects the two functional parts of the safety means with each other, which are, as intended, separable.

The ripping off or breaking of the two circumferential parts at the thin place takes place as a result of the opening movement. The main component of the force causing the ripping or breaking may be directed in the axial direction and also in the circumferential direction, if the folded strip portion sticks to the vessel wall due to friction and a circumferential force is produced which, at least as a component of an effectively acting separating force causes the ripping or breaking. Therefore, it will be referred to as an axial tensile force component and a circumferential bending component which may occur alone or in combination to bring about a separation as a result of an opening movement of the closing device.

It is to be understood that the encompassing can only take place from the inner side of the lid with respect to the roll-up only section-wise in the circumferential direction so that gripping noses as the connecting portion grip around the inner side of the roll-up in a spaced circumferential position to determine the safety section.

A bent design of the inner surface of the gripping noses is provided. This bent design is to be geometrically adapted to the roll-up so that a close contacting abutment is possible. In this connection, a toroidal surface is at least section-wise given, but no complete toroidal shape. The toroidal shape engages the roll-up at its circumference in the rolling direction and along the circumference of the lid (coordinates ρ (rho) and/or ϕ (phi) in the system of the spherical coordinates).

Inasmuch as it was referred to as a roll-up, it extends in the direction of the roll-up by more than 270°, preferably also above 315°, in order to form a practically complete roll-up. A distance is provided between the upper side of the roll-up and the projecting saddle portion of the skirt portion as an intermediate area between the skirt and the roll-up, which can accommodate the clasping nose portions. Here, no tension forces are acting.

A further way of explaining the encompassing is via the angle magnitude, said angle magnitude being another magnitude than that of the roll-up as such. The clasping can take place with more than 160°, preferably more than 220°, up to about 270°, however, is clearly below the roll-up magnitude (the roll-up angle) of the lower end of the skirt portion, and also: the edge portion of the circumferential holding section.

An axial slipping on by a machine is possible due to the resilience of the gripping area of the safety ring and the relative stability of the roll-up. In addition, a gluing or welding or other auxiliary measures can be used.

BRIEF DESCRIPTION OF THE DRAWING

Examples explain and supplement the claimed invention.

DETAILED DESCRIPTION

Figure 1:
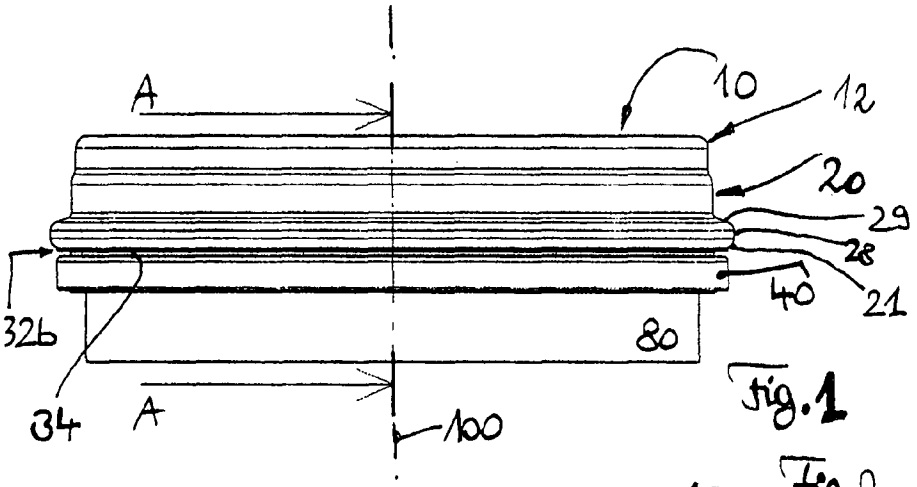
FIG. 1 is a lateral view of a closure lid with a lid panel 10 which is placed onto a container, only the upper body wall area 80 of its neck being shown. A lateral view of the safety ring 40 can be recognized between the container neck and the closure lid.

A lateral view of a closure lid is shown in FIG. 1, which is a PT closure lid (press twist). The closure lid is made of sheet metal and closes a body, only a neck portion 80 thereof being shown. This neck portion is cylindrical and a section of it can be viewed in FIG. 2 along the plane A-A in an opening. The axis 100 forms the central axis which is formed in the center of the cylindrically formed lid with its upper circular lid panel as the panel 10. A transition section 12 is provided at the edge area 10*a* of the panel 10, which forms an arc-shaped transition to a skirt 20 which projects outwards at the lower edge in a saddle-shaped fashion 29 and forms the transition to a roll-up 21, whose inner end 21*a* is bent by almost 360° so that an almost circular complete roll-up is formed as can be seen in the enlargement of the cutout of FIG. 2*a*.

Due to the projecting saddle portion 29 an arc portion of the roll-up 21, which is located innermost does not project farther towards the interior than the skirt 20 before it projects outwards beyond the saddle 29. The skirt portion extends via an arc into an almost cylindrical section at the front (radially outer) end of the projection 29; this is evident in the sectional view of FIG. 2*a* as a straight longitudinal portion 28 before the roll-up begins which is located below the projecting saddle 29.

The straight portion which starts from the saddle 29 is designated with 28; the roll-up 21 begins starting from it and ends at the inner edge 21*a*.

The edge area 12 which is located between panel and skirt 20 accommodates a sealing layer 25 whose upper portion 25*a* extends almost horizontally in a continuous groove 10*a* of the lid panel opposite to the front-side end of the neck 80 with the opening 90. A further portion of the sealing material 25, here designated as 25*b*, is provided for forming a thread section after the axial pressing of the lid onto the thread sections on the container neck (at the outer wall), which are of limited circumferential size and designed in a slightly inclined fashion and which can only be recognized in outlines in the lateral view. These are located in FIG. 2*a* above the vertical section 25*b* of the sealing material 25, which can still be seen at the lower end.

Each customary compound which entails a specific elasticity can be used as sealing material for sealing and which, at the same time, retains a certain stability in order to receive the impressed thread sections and to be available for a twisting opening.

A collar 40 is provided in FIG. 1 as an annular section below the roll-up 21, a gap 34 being recognizable which is explained in greater detail by means of the enlargement of the cutout of FIG. 2*a* which originates from FIG. 2.

Figure 2:
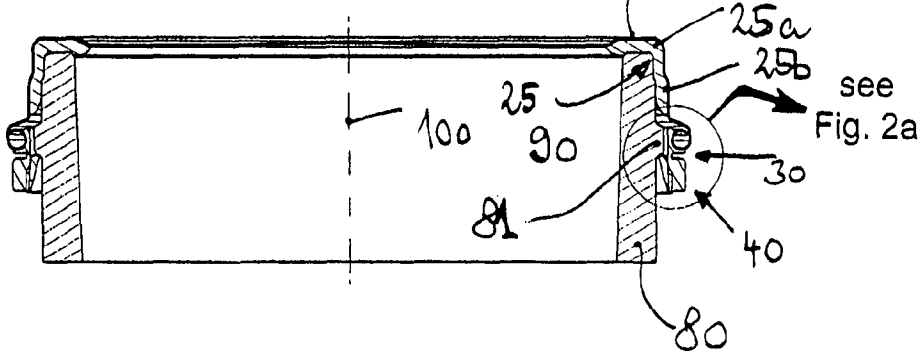
FIG. 2 is a sectional view along the plane A-A of FIG. 1.
Figure 2A:
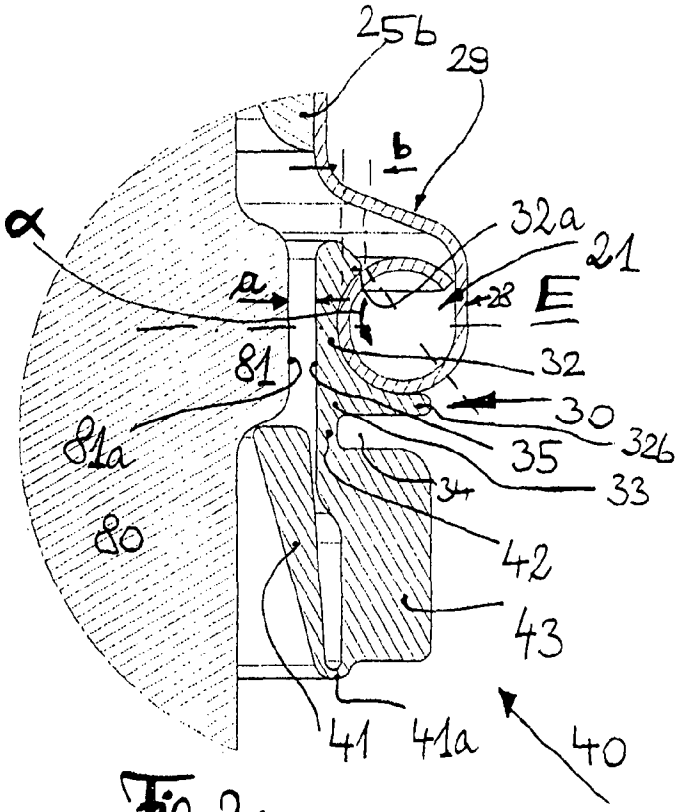
FIG. 2*a* is a cutout as a circular area, which is represented in FIG. 2, only in an enlarged fashion. Here, the edge roll-up 21 of the skirt 20 of the closure lid vis-à-vis a radial projection 81 of the body wall can be recognized.

The circumferential section 40 is a safety section with a molded strip portion 41 that projects radially inwards and upwards and which is visible above a film hinge 41*a* in FIG. 2*a*. It engages under a radial projection 81 of the container that is to be closed. The film hinge 41*a* is not circumferentially continuous, but provided with individual openings or windows which are not visible here, in order to facilitate the folding or folding down of the strip portion 41 and/or in order to be able to carry off collected liquid towards the bottom. The safety section 40 is shown in FIG. 2*a* in a condition mounted to the vessel. It will be explained later how it gets there.

First of all, a further gripping or connecting section 30 is provided above the section 40 which serves for attaching the safety section 40 to the lid and/or a rolled up section 21 which is provided at the lower end of the skirt 20. For this purpose, it is shaped in an arc-shaped fashion and opens towards the outside and comprises outwardly projecting noses 32*a* and 32*b*, whereas the gripping area 32 comprises a surface curvature corresponding to the roll-up and extends vertically to this in the circumferential direction.

Several spaced projections distributed in the circumferential direction are provided in the safety area in FIG. 2*a* which is an enlargement of FIG. 2. The projections serve as noses 32*a* and project beyond the central plane E plotted there and hold onto the roll-up 21. Accordingly, a gripping section that extends by about 90° to the plane E is also provided below the plane E, which forms radially outwards a nose which can be recognized in FIG. 1 as a black strip below the roll-up 21 and above the circumferential strip. A remaining vertical distance which is not occupied, but forms a gap, can also be recognized in FIG. 1 and is provided in an enlarged axial sectional view in FIG. 3 between the lower surface of the projection 32*b* and the upper surface of the main body 43 of the safety section 40.

A plurality of webs 42 that is circumferentially distributed is provided on the radially inner end, which, as thin places, only have a very small circumferential extension as compared with their circumferential distribution and are also formed in a very thin fashion in radial direction. They can be separated or ripped off, if the roll-up 21 together with the gripping area 32, 32*a*, 32*b* is at first twisted in the circumferential direction and is moved upwards by the thread webs. Due to the engagement of the J-shaped (for this reason the name J-band) folded safety strip 41 the safety section 40 with its components 41, 41*a*, 43 cannot follow the upward movement and possibly also not a circumferential movement and the thin places 42 are ripped off, in particular separated. In order to permit this separation, the gripping area 32 with its projections must not let go of the inwardly rolled out roll-up 21 and must remain fixed thereto, even if a resilience and movement radially inwards is possible and permitted.

For this purpose, two measurements a and b are plotted, on the one hand the distance of the inner wall surface 35 of the gripping section 30 and, on the other hand, the radially outwardly directed outer surface 81*a* of the projection 81, which also extends in the circumferential direction. Both strips that extend in the circumferential direction face each other and form a gap which is indicated as the distance a in the section of FIG. 2*a*. The distance b is that distance from the inner surface of the roll-up 21 to the radial outer end of the upper projections serving as upper noses 32*a*. In order to be able to reliably hold, i.e., to comply, with the gripping function of the connection section 30, b is selected not smaller than a, preferably somewhat larger, so that a sliding down and complete detachment of the gripping engagement of the projections 32*a* is not possible despite the movement that is resilient in a radially inward fashion with an axial tensile loading. Then, the inner surface 35 contacts the radially outwards pointing locking surface 81*a* of the projection 81 and blocks a further slipping off of the gripping section from the roll-up 21 which is per se very stable.

The transition portion 33 from the gripping portion 30 to the webs 42 forming the thin places and the underlying main body 43 of the safety section 40 which can be recognized in the lateral view of FIG. 1 must be mentioned.

The size and the type of the encompassing of the gripping section 32 around the inwardly rolled inner roll-up 21 are selected between 160° and 170° in FIG. 2*a*, represented by the angle α. Here, this angle is selected smaller than 180°, but not so small that the condition of the holding is not fulfilled during the axial upward movement.

The mounting of the safety ring 40 takes place prior to a pressing of the lid onto the container. The closure lid with the panel 10, the transition section 12 and the skirt 20 and the roll-up 21 are separately manufactured. The safety section 40, 30 is also separately manufactured e.g., from plastic material. Then, the parts are mechanically fitted together by means of axially moving them towards each other and a locking of the gripping noses 32*a* beyond the inwards projecting surface of the roll-up 21. This axial movement towards each other and the locking can also be called "clicking", which corresponds to the handling and the tonal effect during mounting. A person skilled in the art would talk about a clicking on of the plastic safety section 40, 30, based on the metallic portion of the closure lid and/or its roll-up 21. The strip portion is already present during the clicking on.

During mounting (clicking on) the strip portion 41 is already in the folded condition, two possibilities being given that it is already manufactured in this shape or, however, that it is at first manufactured in such a way that it projects downwards and is then folded over the film hinge 41*a* radially inwards and axially upwards to obtain the shape according to FIG. 2*a*. This depends on the selection of the injection molding process and the way of the special manufacture which includes both possibilities for implementation.

The closed combination of sheet metal lid and plastic part is pressed axially downwards till the strip portion 41 slides across the radial projection 81, the safety section 40 yields elastically outwards without the gripping portion 32 losing its grip which acts on the roll-up from the inside to radially outwards. If the container closed in this fashion is opened at a later date by twisting the closure, the remaining plastic part is torn at the thin place 42 (the sum of the individual small webs in the continuous gap 34) from the safety section 40 and leaves the latter on the container in the separated condition. A third party can recognize the larger gap 34 from the outside, the unique opening is visible and the thin place 42 cannot be restored in such a way that the closed container can be imparted an originally unopened condition by an act of deception.

It is not possible under normal circumstances to separate the plastic part from the metal part after the closing and in the closed condition without said thin place being torn. This is ensured by the gripping area 32 which is inaccessible from the outside at those points which achieve the locking, namely the projections 32*a* that are hidden towards above/below and below the metal skirt 29, 28 and/or a plurality of spaced projections that are distributed circumferentially. The latter permit the mechanical simplification and mechanical implementation of the initial axial telescoping of the sheet metal part and of the safety ring in the still not mounted condition of the closure lid on the container.

Figure 4A:
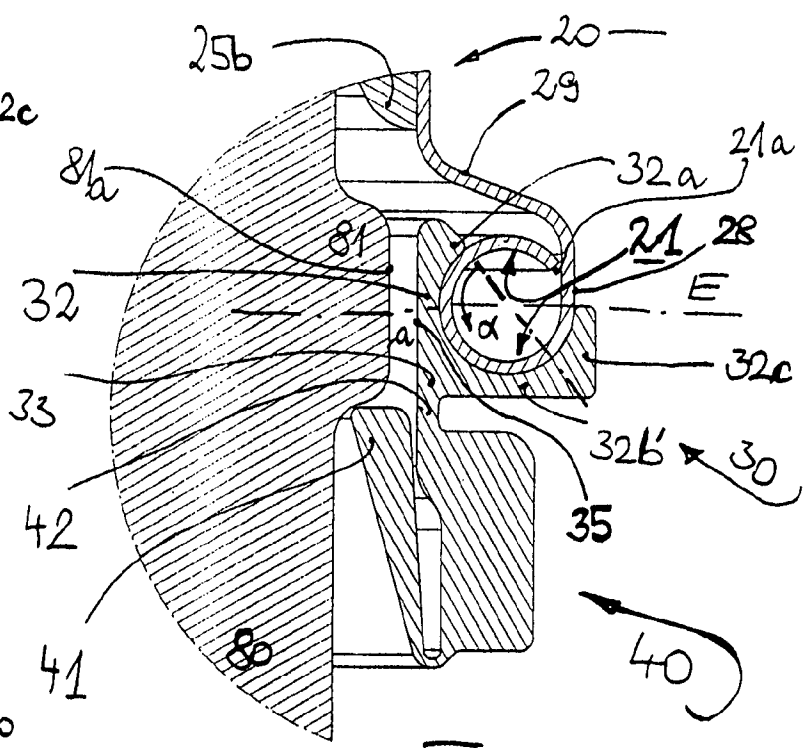
FIG. 4*a* is the enlargement of the cutout of the circle of FIG. 4 in which the roll-up 21 is represented at the lower edge of the skirt 20 of the closure lid vis-à-vis a radial projection 81 of the body wall 80.
Figure 3:
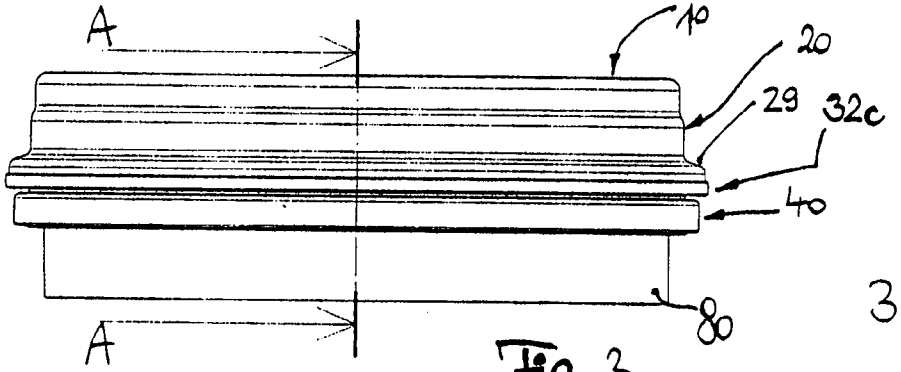
FIG. 3 shows a further embodiment of the same view as FIG. 1.
Figure 4:
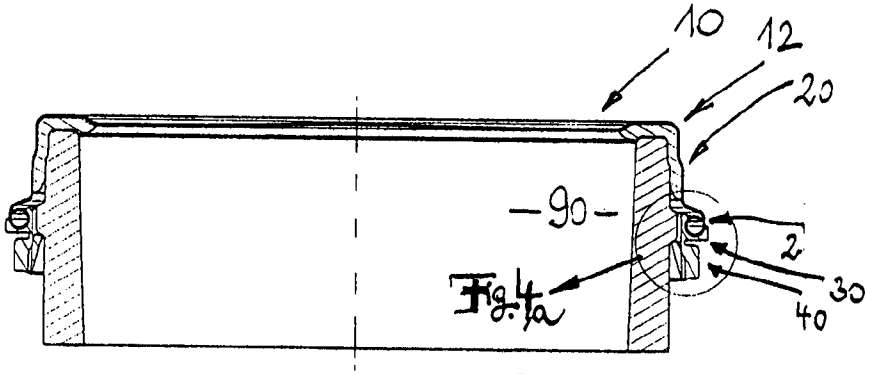
FIG. 4 is a sectional view of the plane A-A of FIG. 3 with the marking of a cutout (circular area at the right-hand margin) which is illustrated in the following FIG. 4*a*.

The detailed description of FIGS. 1, 2 and 2*a* can also be transferred to the three illustrations of FIGS. 3, 4 and 4*a* as regards the almost identical reference numerals.

Here, FIG. 3 is very similar to FIG. 1 only with a different shape of the lower portion of the gripping area 32. Here, this portion is radially displaced towards the outside to a greater extent and identified 32*b*', but is still part of the same gripping and connecting section 30 as regards the function. A cylindrical strip 32*c* is additionally provided on the radially outer end of the horizontally extending lower projection 32*b*' which extends continuously in a circumferential direction, which projects radially at a great distance and projects upwards up to the plane E which was previously described as the central plane of the roll-up 21. This circumferential strip 32*c* is designed in a thicker fashion can also be recognized in FIG. 3 above the safety ring 40 which continues to have the same height by partly engaging over the curvature section of the roll-up 21 in the fourth quadrant of this roll 21. The remaining components of the closure lid, the panel 10, the skirt 20 and the outwardly projecting saddle 29 with vertically sloping flank 28 are unchanged. The upper neck 80 of a container that is inwardly provided with an opening 90 is still closed.

The skirt portion 20 is also referred to as a holding portion since its task is the holding via the compound 25*b*, which cooperates with the screw-type cam of the container. The front-side sealing of the sealing material 25*a* is provided in such a way in the transition section 12 as was previously described.

The combination of gripping and connecting section 30 and the safety ring 40 is also jointly designated as a multi-component safety ring in FIG. 4*a*, which itself is connected through the thin place 2—i.e., several spaced webs—and, during opening, is separated into two parts of a circumferentially extending nature.

The clasping of the gripping section 30 with its inner partly toroidal shape that is partly open towards the outside over the rolled-up lower skirt section 21 can be more clearly seen in FIG. 4*a* and is selected with more than 150°, between 240° and 270°. A clasping to a greater extent, in particular of more than 300° is of little use for retaining. An optimum can be found between the amount of the required plastic material and the necessary holding and gripping function which may also comprise all intermediate versions between a minimalistic approach according to FIG. 2*a* and a rather more general approach according to FIG. 4*a*.

The distance a is again provided between the two opposite annular surfaces 35, 81*a*, here, as well, the measurement b which is not plotted in FIG. 4*a* must be correspondingly determined and selected larger than a. A sealing or welding can reinforce the connection to the roll-up 21. This stronger connection formed by means of heat and/or pressure is not separately represented.

Figure 5:
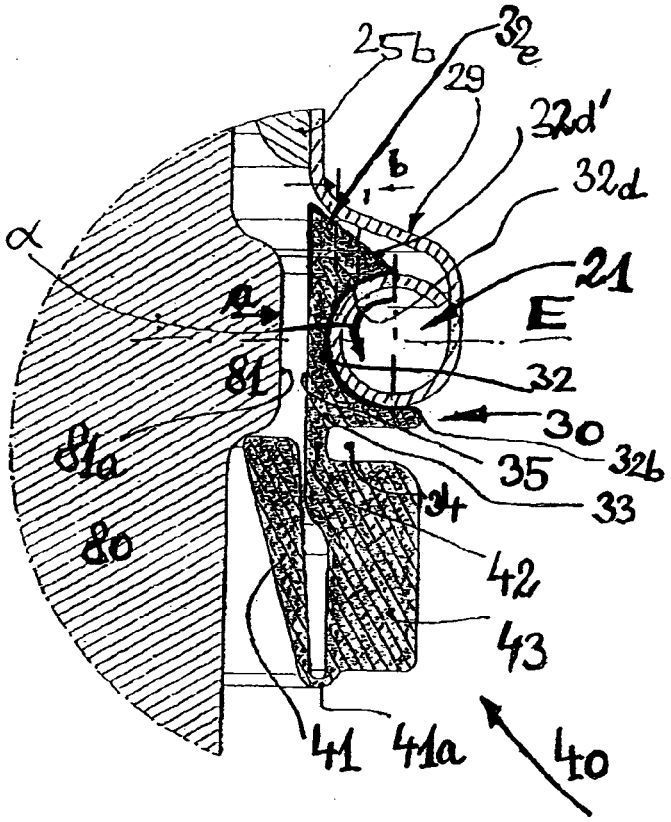
FIG. 5 is an enlarged variant of the embodiment according to FIG. 2*a*.
Figure 6:
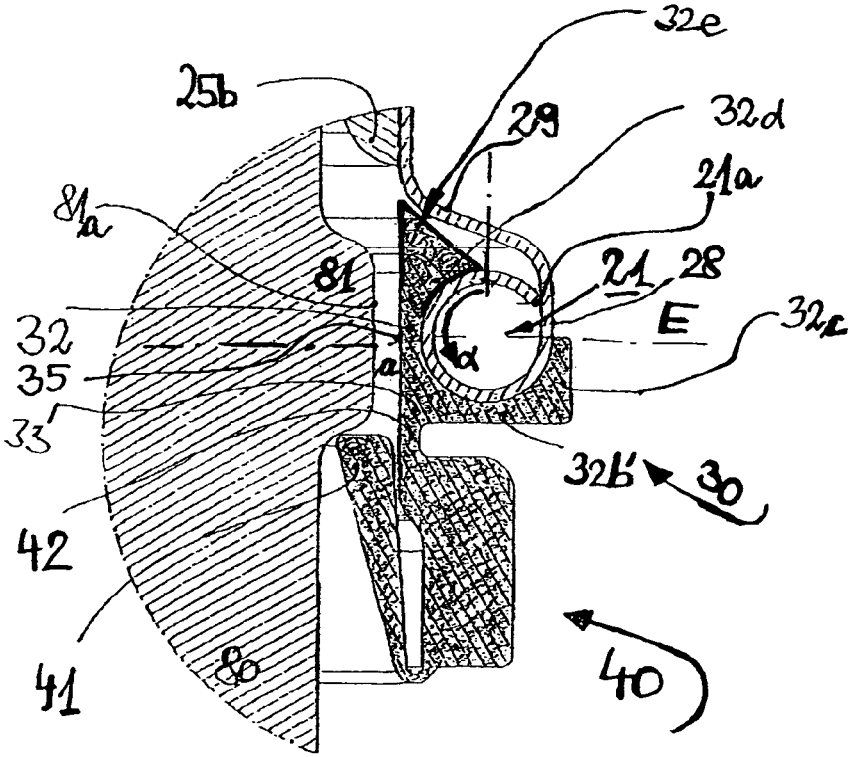
FIG. 6 is an enlarged variant of the embodiment according to FIG. 4*a*.

The clasping is still more pronounced in two further examples in each case with respect to either FIG. 2*a* or FIG. 4*a*, to whose description reference is made inasmuch as FIGS. 5 and 6 are affected.

As compared with FIG. 2*a* a shaping of the gripping area 32 to a greater extent towards above in the area of the noses 32*b* of FIG. 2*a* is provided in FIG. 5. For this purpose, a substantially triangular shape is provided in FIG. 5, which extends as a clasping across the entire second quadrant so that an encompassing angle of somewhat more than 180° results. The axially upwards projecting projections 32*e* on the noses 32*d* that are shaped thicker are closer to the metallic saddle portion 29, but do not contact it so that a minimum distance is maintained.

An obliquely downwardly extending outer surface 32*d*' of each of the noses 32*d* has a different inclination than the saddle surface 29 that is inclined to a lesser degree and ends approximately in the transition portion from the first to the second quadrant as the radially outer ends of the gripping noses 32*d* with the adjoining arc-shaped inner radius that serves for clasping the roll-up 21.

A comparable design of these upper noses 32*d* is found in FIG. 6 maintaining the section according to FIG. 4*a*, which is more enlarged at the bottom and the outside with the section 32*b*', 32*c*. Here, a circumferential gripping angle of almost 270° results without contacting the oblique surfaces 32*d*' of the saddle portion 29 of the metallic part of the lid.

The encompassing takes place from the inside to radially the outside to somewhat more than two quadrants in FIG. 5. In FIG. 6 the encompassing takes place over almost three complete quadrants. Here, as well, all intermediate angles can be implemented. All remaining components are as explained by means of FIGS. 2*a* and/or 4*a*.

What is claimed is:

1. A closing device for a closure lid made of sheet metal suitable for opening by twisting, comprising (a) a lid panel;

(b) a skirt portion on an edge of the lid panel;

(c) a seal extending from a circumferential section of the lid panel into the skirt portion;

(d) the closing device having a non-metallic safety ring comprising two circumferentially extending sections, configured as (i) a safety section with a strip section, shaped to project radially inwards and axially upwards;

(ii) a connecting section for attaching the safety section on an axially lower end of the skirt portion;

(e) the skirt portion having (i) a lower end rolled up from radial outside to radial inside by more than 180° to form a roll-up portion; and (ii) the roll-up portion is at least partly clasped or is claspable by the connecting section from an inner side of the skirt portion.

2. A closing device according to claim 1, wherein:

a horizontal plane extends substantially through a center of the roll-up portion and clasping by the connecting section is provided at least from the inner side of the lid, but from the outer side of the roll-up portion.

3. A closing device according to claim 1, wherein:

the connecting section or its claspability of the roll-up portion extends at the outer side of the lid, up to substantially a height of a central plane of the roll-up portion.

4. A closing device according to claim 1, wherein:

the safety section is coupled to the connecting section through distributed weakened connecting webs as a thin area, said thin area being breakable by at least one axial tensile force component resulting from an opening of the closure lid device by a twisting.

5. A closing device according to claim 1, wherein:

the clasping of the roll-up portion takes place on the inner side through nose portions which extend circumferentially, and being circumferentially spaced.

6. A closing device according to claim 1, wherein:

the strip section is foldable or folded.

7. A closing device according to claim 1, wherein:

the roll-up portion extends from radially outwards towards radially inwards by more than 270°, or by more than 315°.

8. A closing device according to claim 1, wherein:

the connecting section engages with holding forces substantially at the roll-up portion without applying axial forces to a projecting intermediate section of the skirt portion.

9. A closing device according to claim 1, wherein:

the claspability of the connecting section is greater than 150° and less than 300°.

10. A lid for a container open at the top with an upper open end and an upper outer wall configured for closing with the lid, said lid comprising:

a lid panel, a circumferential transition section, and a holding section extending substantially perpendicular to the lid panel, wherein (a) an edge section that is remote from the lid panel being rolled up to form a roll-up portion by more than 180° from an outside to an inside on the holding section and is by more than 150° clasped from a gripping portion of a safety ring;

(b) the safety ring comprises a blocking section which blocks relative to the outer wall against an opening, the opening caused by a twisting or pulling, and the blocking section configured, in use, to be ripped off at a thinned area;

(c) a radially inwards pointing annular surface that extends substantially circumferentially is provided at the gripping portion of the safety ring, and the annular surface has an inner diameter which, in the closed condition of the lid on the container, has a functional distance (a)

from a wall surface of the outer wall in order to block an axially downwardly directed detachment of the safety ring from the roll-up portion.

11. A lid according to claim 10, wherein:

the clasping from the gripping portion takes place with an angle (α) of greater than 160°, or greater than 220°.

12. A lid according to claim 10, wherein:

the edge section of the holding section is rolled up with an angle that is greater than 270°, or greater than 315° or a complete roll-up;

a free end substantially contacts a circumferential strip of the holding section from the inside.

13. A lid according to claim 10, wherein:

the safety ring consists of two functional sections which are connected to each other by a tearable or breakable connection through several connecting areas as a thinned area in order to separate the blocking section from the gripping portion of the safety ring by means of a tensile force which acts in an axial and/or at least part-circumferential fashion.

14. A lid according to claim 10, wherein:

the gripping portion, but not the roll-up portion, are radially resilient in order to permit an axial slipping on and exert radial blocking and clamping forces after the slipping on and to prevent a dropping off.

15. A closing device according to claim 1, wherein:

a clasping connection between a gripping portion of the connecting section and the roll-up is reinforced.

16. A closing device according to claim 1, wherein:

the safety ring has a radially inwardly directed annular surface that faces radially inward toward a wall portion of a container to be closed and extends in a circumferential fashion in a height area of the connecting section.

17. A closing device according to claim 16, wherein:

the annular surface extends at a height that is greater than a diameter of the roll-up portion being an edge section that is remote from the panel.

18. A closing device according to claim 16, wherein:

the annular surface has an inner diameter which, in the closed condition of the closing means on the body, has a small distance (a) from a wall surface that is opposite to a ring surface in order to lock an axially downwardly directed detachment of the safety ring from the roll-up portion.

19. A closing device according to claim 16, wherein:

a part-circumferential clasping above a central plane of the roll-up portion extends radially farther to the outside (b) than a distance (a) of the annular surface from the wall portion.

20. A closing support device on or for a closure lid made of sheet metal which is to be opened by means of twisting, said closure lid comprising:

a lid panel;

a skirt portion on the edge of the lid panel;

a sealing layer extending from a circumferential section of the lid panel into the skirt portion;

(a) said support device comprising a non-metallic safety ring comprising two at least partly circumferential extending sections, including (i) a safety section with a radially inward and axially upward projecting strip section; and (ii) a connecting section for attaching the safety section on an axially lower roll-up of the skirt portion;

(b) the connecting section being configured to at least partly engage a lower end of the skirt portion, being rolled up as roll-up portion by more than 270° from an inner side of the skirt portion.

21. A closing support device according to claim 20, wherein:

the safety section is coupled with the gripping and connecting section through several weak connecting webs, said connecting webs being structured and arranged to tear or break at least partly due to an axial tensile force component.

22. A closing support device according to claim 20, wherein:

the connecting section comprises an outwardly open retainer extending at least partly in an arc-shaped bent manner capable of gripping around the roll-up portion.

23. A closing support device according to claim 20, wherein:

said connecting webs are structured and arranged to tear or break upon an axial opening of the closure lid; and the closing support device, in use, engages in a clamping action.

24. A closing device according to claim 2, wherein:

a gripping section of the connecting section provides for clasping in three quadrants of the roll-up portion.

25. A closing device according to claim 24, wherein:

the gripping section of the connecting section occupies the complete second quadrant or the complete fourth quadrant.

26. A closing device according to claim 1, wherein:

the seal is a sealing layer.

27. A lid according to claim 10, wherein:

the blocking outer wall surface has an upper laterally directed wall surface or an adjacent surface of the safety ring blocks with respect to the wall surface, the surface of the safety ring extending substantially vertically or substantially in parallel with the holding section or substantially vertically to the lid panel.

28. A lid according to claim 10, wherein:

the blocking section has a radially inwardly directed annular surface, structured and arranged to prevent a detachment of the non-separable portion of the safety ring until a separable portion of the safety ring, in use, is torn off from the non-separable portion.

29. A closing device according to claim 1, wherein:

the connecting section is structured and arranged to engage at the roll-up of the skirt portion in a self-retaining manner by means of positive locking.

30. A closing device according to claim 29, wherein:

the connecting section is structured and arranged to engage at the roll-up of the skirt portion by means of a frictional connection.

31. A closing device according to claim 24, wherein:

the third quadrant is completely clasped.

32. A closing device according to claim 2, wherein:

the clasping ends axially above the horizontal plane at the inner side of the lid.

33. A closing device according to claim 4, wherein:

the tensile force component also has a circumferential component.

34. A closing device according to claim 5, wherein:

each nose portion has a curved inner surface structured and arranged to receive the roll-up portion.

35. A closing device according to claim 34, wherein:

each nose portion has an extension in a circumferential direction.

36. A closing device according to claim 15, wherein:

the reinforcement is provided by welding or sealing or by one of pressure and heat influence.

37. A process for providing a closure lid made of sheet metal, the lid being adapted to be opened by twisting, the closure lid comprising:

(a) a lid panel;

(b) a skirt portion on the edge of the lid panel;

(c) a sealing layer extending from a circumferential section of the lid panel into the skirt portion;

(d) a non-metallic safety ring comprising two circumferentially extending sections as:

(i) a safety section with an inwardly and upwardly projecting strip section; and (ii) a connecting section for attaching the safety section on an axially lower end of the skirt portion;

(e) said process comprising:

(i) rolling up the lower end portion of the skirt portion inward by more than 180°; and (ii) clasping the connection section to the rolled-up portion from an inner side of the rolled-up portion to clasp said rolled-up portion.

* * * * *